US006482000B2

(12) United States Patent
Sestrap

(10) Patent No.: US 6,482,000 B2
(45) Date of Patent: Nov. 19, 2002

(54) GASEOUS FUEL AND OXYGEN BURNER

(75) Inventor: Arvo M. Sestrap, Coldstream (CA)

(73) Assignee: Sharjan Venture Ltd., Vernon (CA)

( * ) Notice: Subject to any disclaimer, the term of this patent is extended or adjusted under 35 U.S.C. 154(b) by 0 days.

(21) Appl. No.: 09/884,973

(22) Filed: Jun. 21, 2001

(65) Prior Publication Data

US 2001/0055737 A1 Dec. 27, 2001

Related U.S. Application Data

(60) Provisional application No. 60/213,267, filed on Jun. 22, 2000.

(51) Int. Cl.[7] ..... F23D 14/62
(52) U.S. Cl. ..... 431/353; 431/9
(58) Field of Search ..... 431/353, 350, 431/354, 8, 9, 182, 183, 185, 115, 116; 60/748, 749, 751

(56) References Cited

U.S. PATENT DOCUMENTS 3,195,609 A * 7/1965 Nesbitt et al. ..... 431/9
4,548,578 A * 10/1985 Hannen ..... 431/353
4,798,530 A 1/1989 Sestrap ..... 431/354
5,131,840 A * 7/1992 Zettner ..... 431/353
5,348,469 A 9/1994 Sestrap ..... 431/353
5,385,467 A * 1/1995 Sebastiani et al. ..... 431/354
5,562,438 A * 10/1996 Gordon et al. ..... 431/9
5,611,684 A * 3/1997 Spielman ..... 431/353

FOREIGN PATENT DOCUMENTS

DE 32 32 439 A1 * 3/1983

* cited by examiner

*Primary Examiner*—Henry Bennett
*Assistant Examiner*—Josiah C. Cocks
(74) *Attorney, Agent, or Firm*—Antony C. Edwards

(57) ABSTRACT

No exit-flame burner includes nested elongate mixing and ignition tubes. The mixing chamber tube is of shorter length than the ignition chamber tube and is nested coaxially. The first ends of the ignition and mixing chamber tubes are sealed by a sealing member. A gas port for delivery of oxygen-bearing gas is formed in the sealing member. A gas diffuser is nested coaxially within the mixing chamber tube. A fuel-feeding bore within the gas diffuser is aligned coaxially within the mixing chamber tube. The gas diffuser is shaped as a rhombus in cross-section along the longitudinal axis to thereby define a rim around an apex thereof. The rim extends substantially around, closely adjacent to, a corresponding inside surface of the mixing chamber tube to thereby define an upstream gas plenum upstream of the rim between the rim and the sealing member. In use the burner provides an efficient burn so only heated exhaust gases exit the ignition tube, giving directional control for use of the heat on what may be a small area.

17 Claims, 3 Drawing Sheets

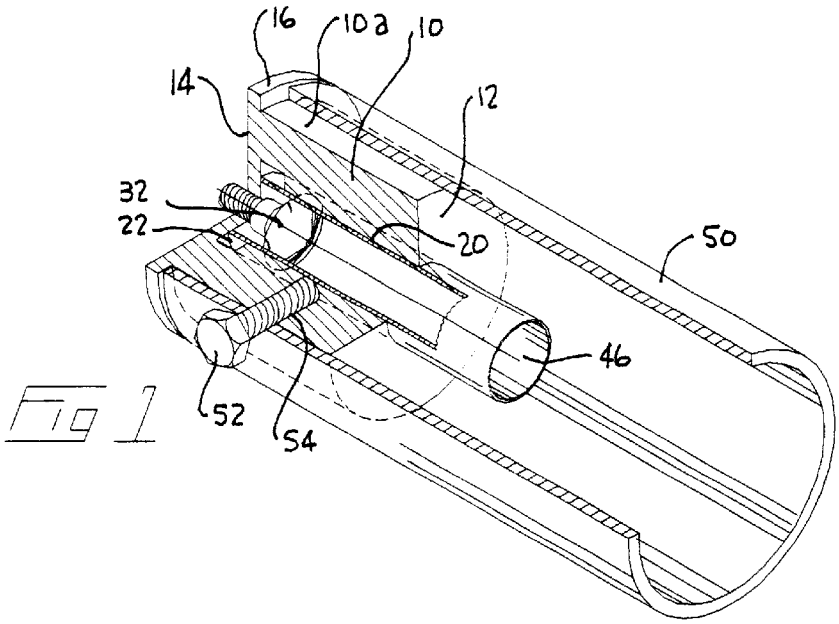
Fig 1
Fig 2
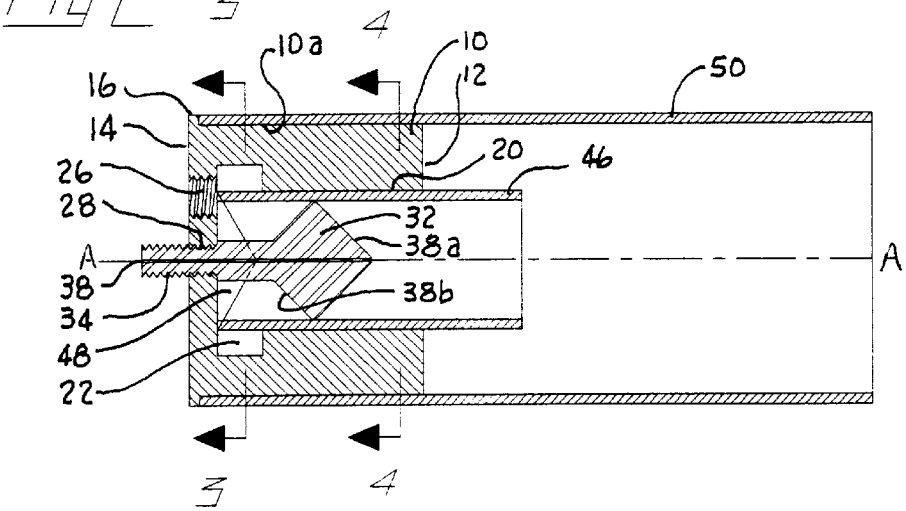
Fig 3
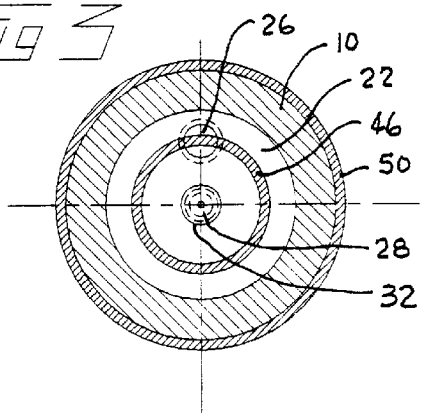
Fig 4
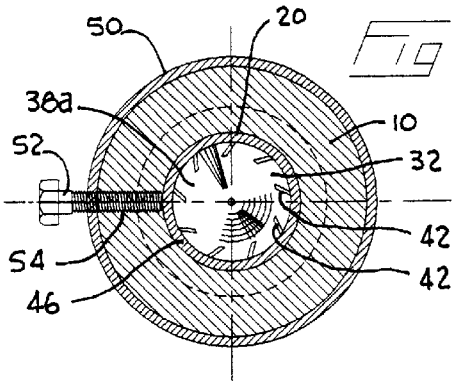

GASEOUS FUEL AND OXYGEN BURNER

CROSS REFERENCE TO RELATED APPLICATION

This application claims priority from U.S. Provisional Patent Application No. 60/213,267 filed Jun. 22, 2000 entitled Gaseous Fuel and Oxygen Burner.

FIELD OF THE INVENTION

This invention relates to an improved combustible fuel and oxygen burner, wherein the combustible fuel and the oxygen are mixed within a mixing chamber, ignited within a surrounding second ignition chamber and the resulting hot gases from the ignited mixture expelled outwardly from the ignition chamber.

BACKGROUND OF THE INVENTION

This invention is an improvement over my earlier disclosure in U.S. patent application Ser. No. 5,348,469, which issued Sep. 20, 1994, titled, Air, Propane and Oxygen Burner With No Exit Flame.

The use of combining a fuel in gaseous form with compressed air or oxygen under pressure to increase the temperature has long been fraught with concerns, among which are those regarding the complexity of controlling the gas mixture, and the difficulty in controlling the exit flame length from the combustion of the fuel.

The present fuel and oxygen burner described herein overcomes these concerns and provides for a fuel/oxygen mixing mechanism which achieves an optimized burn rate. Further, the mixing mechanism ensures combustion takes place internally of the burner so that only heated gases are exhausted from the burner thereby eliminating exit flame.

SUMMARY OF THE INVENTION

The present invention relates to an improved burner which mixes fuel and oxygen or air within in a mixing chamber in the burner. The resulting mixture is ignited within a separate ignition chamber which surrounds the mixing chamber to produce hot gases which are then expelled outwardly from the ignition chamber.

The burner ignition chamber is a hollow tube closed at one end by a plug. The plug is hereinafter alternatively referred to as a cylindrical body section. The cylindrical body section has a bore formed at one end, coaxially with the longitudinal axis of symmetry of the cylindrical body section. The bore extends part way into cylindrical body section and terminates short of the exposed end (the first end) of the cylindrical body section, which is generally co-terminal with one end (the corresponding first end) of the hollow tube, in a radially enlarged plenum chamber. The mixing chamber is formed by insertion of a second smaller diameter tube into the plenum so as to also be coaxial with the longitudinal axis of the cylindrical body section and the hollow tube forming the ignition chamber. The cylindrical body section may have a radially extending shoulder adjacent the co-terminal end of the hollow tube.

The first end of the cylindrical body section incorporates a pair of drilled and threaded passageways. A first passageway serves as an inlet port for a source of combustible fuel. It is located coaxially of the cylindrical body section and extends axially into open communication with the plenum chamber. The second passageway serves as an inlet port for a source of compressed air or oxygen. It is located radially outwardly of, so as to extend parallel to, the first passageway (i.e. radially outwardly relative to the longitudinal axis of the hollow tube), and extends axially a distance sufficient to bring an end of the second passageway into open communication with the plenum chamber.

A diffuser is mounted within the bore of the mixing chamber. The diffuser has a longitudinally extending small diameter axial bore hole, an externally threaded shaft portion, a shoulder portion and a pair of oppositely disposed conically shaped adjacent faces forming a rhombus in cross-section along the bore. The bore hole communicates fuel along the threaded shaft portion, which threads into the first passageway. The convergence of the conically shaped faces forms an annular apex that is only slightly smaller in diameter than the internal diameter of the axial bore of the mixing chamber.

A plurality of slit-like skewed passages are formed equidistantly around the periphery or rim of the annular apex of the diffuser. These slit-like passages may be generally inclined at 30 degrees relative to the longitudinal axis of the mixing chamber.

The mixing chamber is formed within a mixing tube. The mixing tube is mounted in the plenum by being slidably inserted into the axial bore of cylindrical body section, so as to slip over the diffuser. The annular apex of the diffuser snugly fits inside of the mixing tube. The mixing tube has diametrically opposed "V"-shaped notches formed in the end of the mixing tube which is seated in the plenum chamber. The notches are radially offset about the longitudinal axis of the hollow tube relative to the second passageway. The opening of the second passageway into the plenum may be bisected by one edge of the two edges extending between the "V"-shaped notches. The notched end of the mixing tube is placed into firm contact with the inner surface of the plenum chamber, thereby allowing open fluid communication between the interior of the mixing tube and the plenum chamber. Oxygen or air under pressure can then pass from the compressed air passageway (the second passageway) through the plenum chamber into the mixing tube, upstream of the annular apex of the diffuser, i.e. between the apex of the diffuser and the plenum chamber. Contact of the flow of oxygen or air with the first or upstream conically shaped face of the diffuser forces the flow toward the side walls of the mixing tube and through the plurality of skewed passages around the annular apex of the diffuser.

The flow of combustible fuel passes through the longitudinal bore hole of the diffuser into the mixing tube downstream of the diffuser. Once it exits the bore hole it diverges in a divergent stream toward the side walls of the mixing tube. Mixing of the combustible fuel with the oxygen or air exiting from the skewed passages takes place in the mixing tube downstream of the diffuser in the interaction between the two flows, namely between the diverging flow of combustible fuel and the swirling flow of air or oxygen.

As the mixture exits the mixing tube the mixture is ignited for complete combustion within the ignition chamber by any appropriate conventional means.

In summary, the no exit-flame burner of the present invention includes nested elongate mixing and ignition chambers formed in tubes. The ignition chamber tube has a longitudinal axis. The mixing chamber tube is of shorter length than said ignition chamber tube and is nested coaxially along said longitudinal axis so as to nest a first end of said mixing chamber tube in a first end of said ignition chamber tube. In use the burner provides an efficient burn so only heated exhaust gases exit the ignition tube, giving directional control for use of the heat on what may be a small area.

The first ends of the ignition and mixing chamber tubes are sealed by a sealing member. A gas port for delivery of oxygen-bearing gas is formed in the sealing member, positioned radially outwardly of the longitudinal axis.

A gas diffuser is mounted at an upstream end of the diffuser to the sealing member. The diffuser is nested coaxially within the mixing chamber tube, a fuel-feeding bore within the gas diffuser aligned coaxially with the longitudinal axis at an exit orifice of the bore within the mixing chamber tube. The bore communicates in fluid communication with a fuel-feeding infeed mounted on the sealing member.

The gas diffuser, at a downstream end opposite the upstream end, is shaped generally as a rhombus in cross-section along the longitudinal axis to thereby define a rim around an apex thereof. The rim is orthogonal to the longitudinal axis and sized to extend substantially around, closely adjacent to, a corresponding inside surface of the mixing chamber tube to thereby define an upstream gas plenum upstream of the rim between the rim and the sealing member.

A radially spaced apart array of flow-directing slits are formed in the rim. They are radially spaced apart around the longitudinal axis. The slits direct a gas flow from the plenum into adjacency to the exit orifice of the bore in the mixing chamber tube downstream of the rim. The slits in the array of flow-directing slits may be skewed from a downstream flow direction parallel to the longitudinal axis. In particular, the slits may be skewed by a skew angle of, for example 30 degrees, so as to impart a counter-clockwise swirl to the gas flow when viewed from downstream along the gas flow.

In one embodiment the tubes are cylindrical, and the diffuser defines a pair of opposed facing frusto-conical surfaces intersecting at the rim. The frusto-conical surfaces may define included angles of 45 degrees between the surfaces and the longitudinal axis.

The sealing member may be a solid plug having a mixing tube bore therein, where the mixing tube bore is coaxial with the longitudinal axis and sized to snugly hold the mixing chamber tube therein. A radially expanded annular plenum may be formed in an upstream end of the receiving bore in fluid communication with the gas port.

A perimeter portion of an upstream end of the mixing chamber tube may bisect the gas port, and the upstream end of the mixing chamber tube may abut an interior upstream surface of the plenum. The perimeter portion may be notched.

BRIEF DESCRIPTION OF THE DRAWINGS

FIG. 1 is an isometric view of the nozzle and burner assembly, partially cut-away showing the relative positioning of the various components.

FIG. 2 is a longitudinal sectional view through the burner assembly of FIG. 1.

FIG. 3 is a cross sectional view taken on line 3—3 of FIG. 2.

FIG. 4 is a cross sectional view taken on line 4—4 of FIG. 2.

DETAILED DESCRIPTION OF EMBODIMENTS OF THE INVENTION

Figure 5:
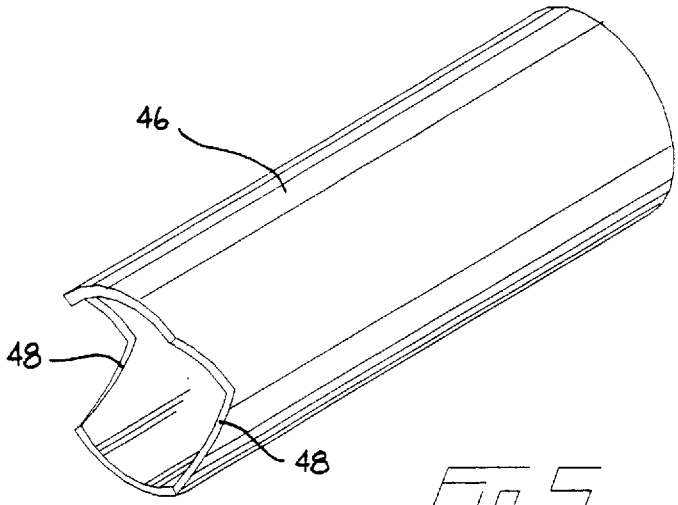
FIG. 5 is an isometric view of the mixing tube.
Figure 6:
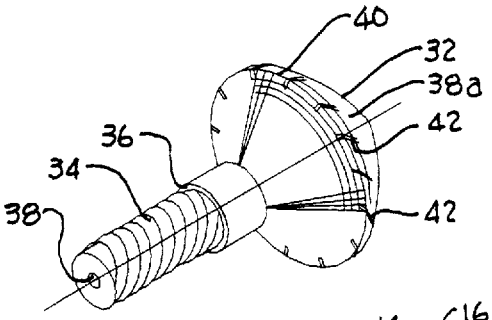
FIG. 6 is an isometric view of the conically shaped oxygen deflector.
Figure 7:
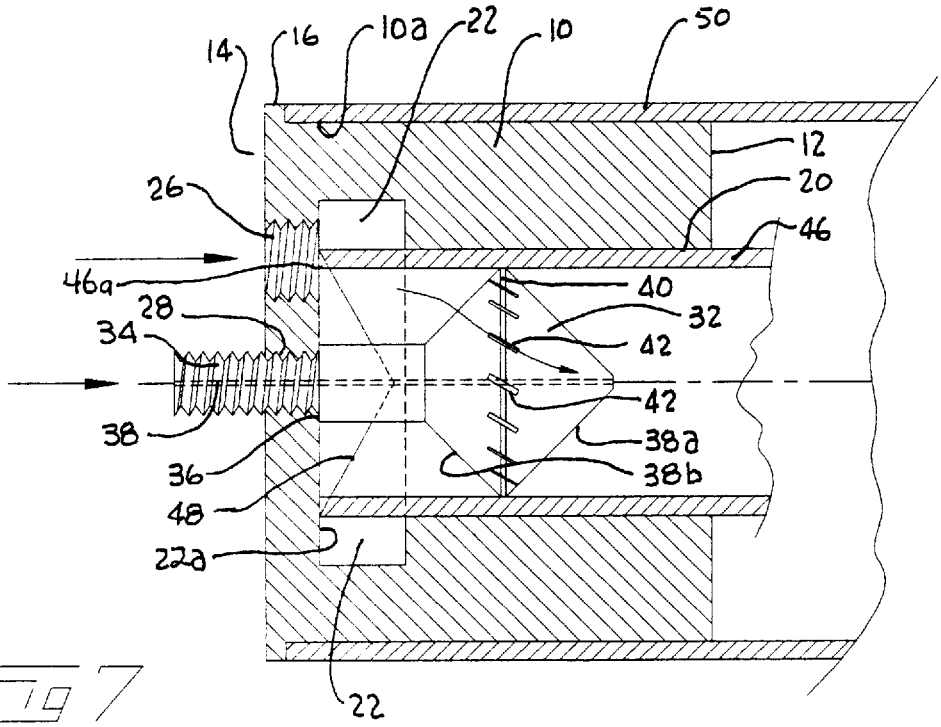
FIG. 7 is an enlarged partial longitudinal sectioned view of the burner of FIG. 2.

The improved burner of the present invention is a hollow tube plugged at one end by a hollow cylindrical body section 10. Body section 10 has inner and outer planer faces 12 and 14 respectively. Body section 10 has on its exterior surface a radially recessed portion 10*a* to thereby define a radially outwardly extending shoulder 16 adjacent outer planer face 14. Axial bore 20 extends from face 12 part way into body section 10. Bore 20 is radially enlarged over part of its length, adjacent to outer planer face 14, so as to form an annular plenum chamber 22 within body section 10. Bore 20 is coaxial with longitudinal axis of symmetry A.

The outer face 14 of body section 10, opposite bore 20, has a pair of threaded passageways, 26 and 28 respectively. Passageway 28 serves as an inlet port for a source (not shown) of combustible fuel and is located coaxially of the body section 10. It extends axially part way into the body section into open fluid communication with the plenum chamber 22. Passageway 26 serves as an inlet port for a source (not shown) of compressed air or oxygen and is located radially outwardly of axis A, toward the circumference of body section 10. The source of compressed air or oxygen may be a compressor or, potentially, a blower. Passageway 26 extends axially into the body section 10 a distance sufficient to bring an end of the passageway into open communication with plenum chamber 22.

A diffuser 32, having an externally threaded shaft 34 and a shoulder 36, is inserted into axial bore 20. Shaft 34 is threaded into passageway 28 until shoulder 36 is firmly seated against the inner surface 22*a* of plenum chamber 22. Such contact of shoulder 36 with wall 22*a* seals the plenum. A portion of threaded shaft 34 extends outwardly of outer planer face 14. Diffuser 32 projects coaxially into bore 20.

Diffuser 32 has a small diameter longitudinal bore hole 38 therethrough and oppositely disposed conically shaped adjacent faces 38*a* and 38*b*. The faces have a slope of substantially 45 degrees. When viewed in cross-section along axis A diffuser 32 is shaped as a rhombus. The common annular apex 40 of faces 38*a* and 38*b* is axially centered about longitudinal bore 38. Apex 40 is formed by the convergence of faces 38*a* and 38*b* has a diameter slightly less than bore 20. A plurality of slit-like passages 42 are formed equidistantly around the periphery of apex 40. Passages 42 are generally positioned at 30 degrees relative to longitudinal axis of bore 38 and skewed to the right when viewed from the direction of flow through longitudinal bore 38. Passages 42 are all inclined counterclockwise when viewed end-on through the open end of mixing tube 46 such as seen in FIG. 4.

Mixing tube 46 is a rigid hollow tube approximately two and one half inches in length. One end has diametrically opposed "V"-shaped notches 48. Tube 46 is slid into axial bore 20 of body section 10, snugly over diffuser 32, such that the notched end of mixing tube 46 is brought into firm contact with the inner surface 22*a* of plenum chamber 22. The internal diameter of mixing tube 46 is substantially the same as the apex 40 of diffuser 32. Notches 48 formed in mixing tube 46 ensure that the interior of mixing tube 46 is in open communication with plenum chamber 22 thus permitting a free flow of oxygen under pressure to pass from passage 26 through plenum chamber 22 and into the upstream portion of mixing tube 46, that is, the portion between apex 40 of diffuser 32 and plenum chamber 22. Edge 46*a* of mixing tube 46 extends between notches 48. Edge 46*a* may in one embodiment generally bisect the opening of passageway 26. Edge 46*a* and its adjacent outer surface of tube 46 serves to deflect air from passageway 26 around plenum 22 so as to direct the air toward notches 48. Some air from passageway 26 enters into the upstream end of tube 46 directly. The object is to somewhat equalize the air pressure behind the diffuser, that is, upstream of face 38*b* between the plenum and the diffuser. This may also be accomplished for example by having a plurality of passageways 26 radially spaced around plenum 22.

An elongate, rigid outer burner tube 50 is slidably inserted over radially decreased portion 10*a* of body section 10, into engagement against upstanding shoulder 16. Burner tube 50 and mixing tube 46 are secured in place by the insertion of a machine screw 52 through a hole formed in burner tube 50 into a threaded hole 54 formed in body section 10 until screw 52 firmly contacts mixing tube 46.

The combustible fuel for the burner of the present invention may include compressed natural gas, hydrogen, butane, alcohols, hydrocarbons, combustible solids such as coal or organics in powder or slurry, or atomized liquid fuels atomized by conventional means known in the art. Propane is the intended fuel for the illustrated embodiment. The fuel supply is coupled by conventional means such as pipe fittings to inlet port or passageway 28. A source of compressed air or oxygen is coupled by conventional means such as pipe fittings to the compressed air inlet port 26. ⅛ inch pipe fittings (O.D.) may be used. Fuel may be introduced over a range of pressures, for example, from a low pressure of 2 PSI which produces a barely discernable flame, to 15 PSI (given the propane example) via inlet port 28 through longitudinal bore 38 of diffuser 32 into the mixing tube 46. Concurrently, compressed air which may be in the range between 10 to 110 PSI is introduced into the plenum chamber 22 via inlet port 26.

The range of pressures used is not intended to be limiting. What governs the ratio of pressures (fuel and air) and amount of pressure used is the desired amount of heat to be produced and the desired efficiency of the burn. The better the mixing, the better the efficiency of the burn. An efficient burn is a flame which remains in the ignition chamber with no exit flame. As will be appreciated by one skilled in the art, if the burn is efficient, increasing the fuel flow rate increases the amount of heat produced. For proper mixing then, a commensurate increase in the air flow accompanies an increased fuel flow rate. Thus an increased fuel supply pressure is accompanied by an increase in the pressure (and corresponding volume) of the air supply. In terms of air flow volume, applicant has successfully used in the propane embodiment illustrated both a 7.5 CFM and an 18.5 CFM compressor, the latter being sufficient to simultaneously supply two burners.

As the fuel flow passes out of longitudinal bore 38 into mixing tube 46, the flow diverges radially outwardly toward the side walls of mixing tube 46. The flow of air or oxygen first passes from plenum 22 into the mixing tube behind, that is, upstream of diffuser 32, where the flow is directed toward the side walls of the mixing tube by conically shaped face 38*b*. The convergent annular space between face 38*b* and mixing tube 46 acts as one side of a venturi.

Passages 42 on apex 40 restrict the flow and impart a swirling action to the flow as it flows outwardly from apex 40 and into the mixing tube 46. Passages 42, by restricting the flow, also likely assist in equalizing the air pressure in the upstream flow as it spreads radially around conical face 38*b*. The divergent annular space between downstream conical face 38*a* and mixing tube 46 acts as the downstream side of the venturi. The swirling action assists in producing a thorough mixing in the mixing tube of the fuel with the air or oxygen. The resulting mixture then flows into ignition tube 50. The mixture is ignited by any appropriate and conventional means of ignition such as would be known in the art as it exits the mixing tube 46 into ignition tube 50.

Figure 8:
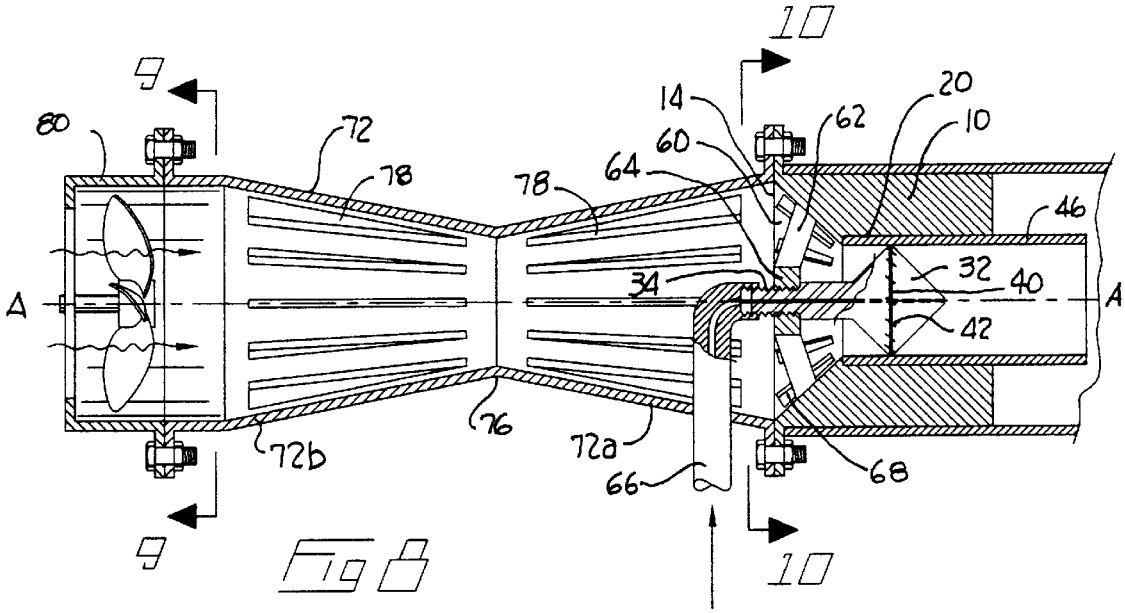
FIG. 8 is a sectional view of a modified burner containing a forced air inlet with internal air directing fins.
Figure 9:
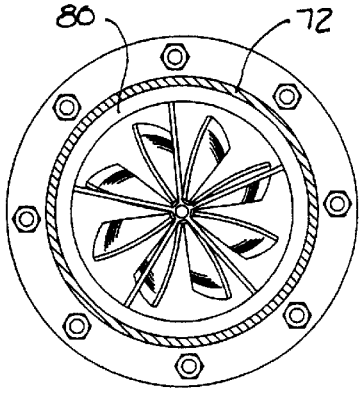
FIG. 9 is a sectional view taken on line 9—9 of FIG. 8.
Figure 10:
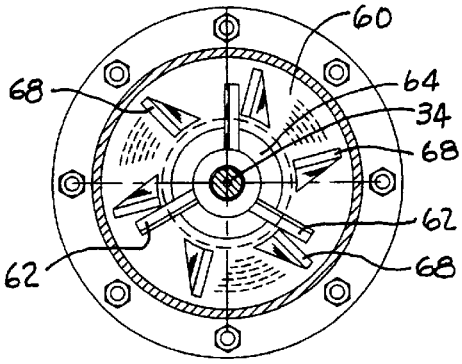
FIG. 10 is a sectional view taken on line 10—10 of FIG. 8.

The resultant flame front propagates rapidly and evenly in tube 50, rendering a complete and efficient burn which extends for approximately six inches beyond the end of mixing tube 46 so as to remain within tube 50. It will be understood that the outer burner tube 50 is of a length appropriate to the particular application. With the air: fuel ratio appropriately adjusted, and with an appropriate fuel flow rate, an efficient burn and a sufficiently long tube 50 ensures that only exhaust gases, pushed forward by the compressed air flow emerge at the downstream end of tube 50.

Where a greater burn temperature is desired, that is greater than 800 degrees Fahrenheit, or where a burn tube of significantly increased diameter is to be utilized, that is greater than 12 inches in diameter, a greater volume of combustion air is obviously required. The previously described apparatus may be easily adapted, as illustrated in FIGS. 8 through 10, to incorporate such improvements.

Body section 10 is constructed with an axially aligned opening 60, which essentially replaces plenum chamber 22 previously described. Opening 60 is conical in shape with a large diameter inlet orifice extending through outer face 14 and terminating in a substantially restricted outlet orifice coincident with axial bore 20. A threaded holding nut 64 is mounted, coincident with axis A, within opening 60 by means of a plurality of radially spaced fin-like struts 62. Externally threaded shaft 34 of diffuser 32 is secured as by threading or the like within nut 64 and fuel inlet supply line 66 is then attached to threaded shaft 34. Struts 62 may be generally aligned with slit-like passages 42 formed on the apex 40 of diffuser 32.

Positioned radially about the inside of opening 60 are air flow directing vanes 68. Vanes 68 may also be generally aligned with passages 42 formed on diffuser 32. So aligned, vanes 68 and struts 62 may contribute to a smooth airflow parallel to and through passages 42 formed on diffuser 32.

An air chamber 72 is securely fastened by bolting or the like, in axial alignment, with body section 10 of the burner. Air chamber 72, is generally circular in cross section and has a hour-glass shape when viewed in longitudinal section. Fore and aft sections 72*a* and 72*b* respectively of air chamber 72 have aligned inlet and outlet ports whose internal dimensions substantially match opening 60 in outer wall 14 of body section 10. Sections 72*a* and 72*b* of air chamber 72 converge from their respective inlet and outlet ports toward a medial point creating a neck or throat 76 which substantially matches in size that of mixing tube 46. An array of radially positioned air flow directing vanes 78 are formed in both fore and aft sections 72*a* and 72*b* respectively of air chamber 72. Vanes 78 extend longitudinally through fore and aft sections 72*a* and 72*b* of air chamber 72. Such airflow, when in contact with radially spaced struts 62 and vanes 68 positioned within opening 60, is slightly redirected in a downstream clockwise direction substantially in alignment with passages 42 formed on the apex 40 of diffuser 32.

The aft end 72*b* of air chamber 72 may be connected to a blower 80 or similar device for supplying a large volume of combustion-supporting gas such as air or other oxygen-burning gas.

As will be apparent to those skilled in the art in the light of the foregoing disclosure, many alterations and modifications are possible in the practice of this invention without departing from the spirit or scope thereof.

What is claimed is:

1. A no exit-flame burner comprising an elongate ignition chamber tube having a longitudinal axis, an elongate mixing chamber tube of shorter length than said ignition chamber tube nested coaxially along said longitudinal axis within said mixing chamber tube so as to nest a first end of said mixing chamber tube in a first end of said ignition chamber tube, said first ends of said ignition and mixing chamber tubes sealed by a sealing member, a gas port for delivery of oxygen-bearing gas, formed in said sealing member positioned radially outwardly of said longitudinal axis, a gas diffuser mounted at an upstream end to said sealing member and nested coaxially within said mixing chamber tube, a fuel-feeding bore within said gas diffuser aligned coaxially with said longitudinal axis at an exit orifice of said bore within said mixing chamber tube, said bore communicating in fluid communication with a fuel-feeding infeed mounted on said sealing member, wherein said gas diffuser at a downstream end opposite said upstream end is shaped generally as a rhombus in cross-section along said longitudinal axis to thereby define a rim around an apex thereof, said rim orthogonal to said longitudinal axis and sized to extend substantially around, closely adjacent to, a corresponding inside surface of said mixing chamber tube to thereby define an upstream gas plenum upstream of said rim between said rim and said sealing member, a radially spaced apart array of flow-directing slits formed in said rim, radially spaced apart around said longitudinal axis, for directing a gas flow from said plenum into adjacency to said exit orifice of said bore in said mixing chamber tube downstream of said rim.

2. The device of claim 1 wherein said array of flow-directing slits are skewed from a downstream flow direction parallel to said longitudinal axis.

3. The device of claim 2 wherein said array of flow-directing slits are skewed by a skew angle so as to impart a counter-clockwise swirl to said gas flow when viewed from downstream along said gas flow.

4. The device of claim 3 wherein each slit in said array of flow-directing slits is skewed by said skew angle and wherein said skew angle is 30 degrees.

5. The device of claim 1 wherein said tubes are cylindrical.

6. The device of claim 1 wherein said diffuser defines a pair of opposed facing frusto-conical surfaces intersecting at said rim.

7. The device of claim 6 wherein said frusto-conical surfaces define included angles of 45 degrees between said surfaces and said longitudinal axis.

8. The device of claim 1 wherein said sealing member is a solid plug having a mixing tube bore therein, said mixing tube bore coaxial with said longitudinal axis and sized to snugly hold said mixing chamber tube therein.

9. The device of claim 8 wherein a radially expanded annular plenum is formed in an upstream end of said receiving bore in fluid communication with said gas port.

10. The device of claim 9 wherein a perimeter portion of an upstream end of said mixing chamber tube bisects said gas port, said upstream end of said mixing chamber tube abutting an interior upstream surface of said plenum.

11. The device of claim 10 wherein said perimeter portion is notched.

12. The device of claim 9 wherein said tubes are cylindrical.

13. The device of claim 9 wherein said array of flow-directing slits are skewed from a downstream flow direction parallel to said longitudinal axis.

14. The device of claim 13 wherein said array of flow-directing slits are skewed by a skew angle so as to impart a counter-clockwise swirl to said gas flow when viewed from downstream along said gas flow.

15. The device of claim 14 wherein each slit in said array of flow-directing slits is skewed by said skew angle and wherein said skew angle is 30 degrees.

16. The device of claim 9 wherein said diffuser defines a pair of opposed facing frusto-conical surfaces intersecting at said rim.

17. The device of claim 16 wherein said frusto-conical surfaces define included angles of 45 degrees between said surfaces and said longitudinal axis.

* * * * *